US005712083A

United States Patent [19]

Hosoya et al.

[11] Patent Number: 5,712,083

[45] Date of Patent: Jan. 27, 1998

[54] METHOD OF PREPARING MONODISPERSE TABULAR-GRAIN SILVER HALIDE EMULSION, AND PHOTOGRAPHIC MATERIAL COMPRISING THE SAME

[75] Inventors: Yoichi Hosoya; Junichi Yamanouchi, both of Kanagawa, Japan

[73] Assignee: Fuji Photo Film Co., Ltd., Kanagawa, Japan

[21] Appl. No.: 645,707

[22] Filed: May 14, 1996

[30] Foreign Application Priority Data

Jun. 6, 1995 [JP] Japan ..... 7-161592

[51] Int. Cl.[6] ..... G03C 1/015; G03C 1/043

[52] U.S. Cl. ..... 430/567; 430/569; 430/602; 430/637

[58] Field of Search ..... 430/569, 602, 430/637, 457

[56] References Cited

U.S. PATENT DOCUMENTS 5,439,787 8/1995 Yamanouchi et al. ..... 430/569

*Primary Examiner*—Mark F. Huff

*Attorney, Agent, or Firm*—Sughrue, Mion, Zinn, Macpeak & Seas, PLLC

[57] ABSTRACT

A method of preparing a silver halide emulsion is disclosed, comprising a disperse medium and silver halide grains, said method comprising the steps of:

(1) forming silver halide tabular grains for the silver halide emulsion in the presence of at least one polymer having repeating units represented by formula (1), (2) subsequently to the step (1), removing the polymer by washing with water, and (3) using as seed crystals the silver halide tabular grains obtained via steps (1) and (2) and further growing these grains;

$$-(R-O)_n- \quad (1)$$

wherein each R represents an alkylene group having 2 to 10 carbon atoms, and n is an average number of repeating units which ranges from 4 to 200, and further a silver halide photographic material is disclosed, comprising the above silver halide emulsion.

8 Claims, No Drawings

METHOD OF PREPARING MONODISPERSE TABULAR-GRAIN SILVER HALIDE EMULSION, AND PHOTOGRAPHIC MATERIAL COMPRISING THE SAME

FIELD OF THE INVENTION

The present invention relates to a method of preparing a tabular silver halide photographic emulsion and a photographic material using such the emulsion. In particular, the present invention relates to a method of preparing a monodisperse high-speed tabular silver halide emulsion.

BACKGROUND OF THE INVENTION

Silver halide grains which contain at least two parallel twin planes per grain take tabular shapes. (These grains are called tabular grains, hereinafter). Photographic characteristics of such tabular grains are as follows:

1) The ratio of the surface area to volume (called the specific surface area, hereinafter) of each grain is great, so a good deal of sensitizing dye can be held by adsorption on the grain surface. As a result, those grains have relatively high sensitivity to color sensitization.
2) When an emulsion containing tabular grains are coated on a support and dried, the grains are oriented in the direction parallel to the support surface. Therefore, the scattering of light from the grains is reduced; as a result, sharpness and resolution can be improved. In addition, such an orientation of the grains enables a reduction in thickness of the emulsion coating to improve the sharpness.
3) The progress of development can be speeded up because the grains have large specific surface areas.
4) The covering power is high, and so a saving of silver becomes possible.

Owing to their many advantages as mentioned above, tabular grains have so far been used for commercially available high-speed photographic materials.

The emulsion grains having aspect ratios of at least 8 are disclosed in JP-A-58-113926, JP-A-58-113927 and JP-A-58-113928 (The term "JP-A" as used herein means an "unexamined published Japanese patent application"). The term "aspect ratio" refers to the diameter/thickness ratio of a tabular grain. The term "diameter" used herein signifies the diameter of a circle having the same area as the projection area of a grain, and the term "thickness" used herein is defined as the distance between the two parallel principal surfaces which constitute a tabular grain.

However, as is apparent from the Examples of the references cited above, the tabular grains prepared by well-known methods are inferior in monodisperse properties.

More specifically, conventional tabular grains are (1) broad in distribution of projection area diameters, and (2) obtained as a mixture with grains having rod shapes, grains having tetrapod shapes, grains having single twinning structures, grains having non-parallel twin planes, and so Accordingly, they have drawbacks, e.g., such that:

1) increasing the contrast of the characteristic curve cannot be expected,
2) when an emulsion in which coarse and fine grains are present together is chemically sensitized, it is difficult to confer optimum chemical sensitization upon all the grains because coarse and fine grains differ in optimum condition for chemical sensitization, and
3) the coating of an emulsion in which coarse and fine grains are present together cannot fully utilize the so-called interimage effect, and so its sensitivity is low in respect of light utilization efficiency, compared with that of a double-layer coating provided with a monodisperse coarse-grain emulsion as the upper layer and a monodisperse fine-grain emulsion as the lower layer.

Therefore, various attempts to prepare monodisperse tabular grains have hitherto been made, and several patents are disclosed. For instance, the monodisperse tabular grains disclosed in JP-A-52-153428 are under the restriction of using AgI crystals as their nuclei, and the grains obtained have a low proportion of tabular grains. JP-A-55-142329 discloses the growth conditions for preparing monodisperse tabular grains, and the produced grains are low in proportion of tabular grains. JP-A-51-39027 discloses the method of preparing monodisperse twinned grains, in which after nucleation a silver halide solvent is added for ripening, followed by growth, but the produced grains have a low proportion of tabular grains obtained and have low aspect ratios. As another patent regarding monodisperse twinned grains, there can be cited JP-A-61-112142 which discloses the process of grain formation. In this patent, spherical grains are used as seed crystals, and so the aspect ratio achieved is not more than 2.2 and the proportion of tabular grains to the total grains obtained is low. The monodisperse tabular grains disclosed in French Patent 2,534,036 are formed by the method of ripening without use of a silver halide solvent after nucleation, and have a variation coefficient of 15% with respect to the diameters of their circle equivalents (the variation coefficient is defined as the value obtained by multiplying 100 by the quotient of the standard deviation of diameters of circle equivalents divided by the average of diameters of circle equivalents). From calculations using the electron micrographs of grains shown in Examples of that patent, the proportion of tabular grains with triangular shapes is estimated to be at least 50%, based on projection area. Those tabular grains with triangular shapes are grains having three twin planes parallel to their individual principal planes, according to J. E. Maskasky, *J. Imaging Sci.*, 31 (1987), pages 15–26.

Further, the monodisperse tabular grains including the tabular grains with hexagonal shapes are disclosed in JP-A-63-11928, JP-A-63-151618 and JP-A-02-838. Those tabular grains with hexagonal shapes have, unlike the foregoing tabular grains with triangular shapes, two parallel twin planes per grain. In the references cited above are described monodisperse tabular grains such that the proportion of tabular grains to the total grains is 99.7%, based on projection area, and the variation coefficient is 10.1% with respect to the diameters of circle equivalents. On the other hand, U.S. Pat. Nos. 5,147,771, 5,171,659, 5,147,772 and 5,145,553 disclose the method of preparing monodisperse tabular grains by performing nucleation in the presence of polyalkylene oxide block copolymers. In addition, EP-A-0514742 discloses the monodisperse tabular-grain emulsions having variation coefficients of not more than 10%. This patent also uses the polyalkylene oxide block copolymers cited above in all the Examples thereof. Further, the method of preparing monodisperse tabular grains by the use of the compounds by which the defects of the foregoing polyalkylene oxide block copolymers are improved is disclosed in JP-A-7-28183. When the composition of tabular grains is pure silver bromide, all of those compounds have great effects upon the tabular grains, namely they enable the grains to have very high aspect ratios and to be a monodisperse system. In the case of silver iodobromide tabular grains, however, the compounds fail to confer high aspect ratios upon the grains to give rise to an increase in thickness of the tabular grains.

SUMMARY OF THE INVENTION

Therefore, an object of the present invention is to prepare monodisperse tabular emulsion grains with hexagonal shapes, and thereby to produce a high-speed photographic material.

The above-described object of the present invention is attained with a method of preparing a photographic emulsion, wherein silver halide tabular grains are formed in the presence of a water-soluble polymeric compound comprising repeating units of formula (1) which enables the silver halide tabular grains to be a monodisperse system, and then the compound which becomes useless is removed by washing with water, and further the tabular grains are made to grow. In accordance with this method, monodisperse tabular grains having high aspect ratios can be obtained. In particular, monodisperse tabular grains of small thickness can be obtained even in the case of silver iodobromide although generally it has so far been difficult to prepare tabular silver iodobromide grains of small thickness in the presence of the compound of this type.

DETAILED DESCRIPTION OF THE INVENTION

Polymers used for the silver halide emulsion of the present invention are described below in detail.

The polymers used during preparation of the present tabular-grain emulsion are polymers comprising repeating units represented by the formula (1):

$$-(R-O)_n- \quad (1)$$

wherein each R represents an alkylene group having from 2 to 10 carbon atoms, and n is an average number of repeating units which ranges from 4 to 200.

In making the present emulsion, though any polymer can be used as far as it has the repeating units of formula (1), it is desirable to use a vinyl polymer containing at least one monomer represented by formula (2) as a constituent monomer, or a polyurethane represented by formula (3). In particular, the vinyl polymer containing a monomer of formula (2) as constitutional repeating units is preferred.

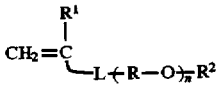

(2)

In the foregoing formula, R and n have the same meanings as described in formula (1), respectively, $R^1$ represents a hydrogen atom or a lower alkyl group, $R^2$ represents a monovalent substituent group, and L represents a divalent linking group.

More specifically, $R^1$ represents a hydrogen atom or a lower alkyl group having 1 to 4 carbon atoms (methyl, ethyl, n-propyl, n-butyl ), particularly preferably a hydrogen atom or a methyl group.

$R^2$ represents a monovalent substituent group having not more than 20 carbon atoms, with suitable examples including a hydrogen atom, a substituted or unsubstituted alkyl group having 1 to 20 carbon atoms (e.g., methyl, ethyl, isopropyl, n-hexyl, n-dodecyl, benzyl, 2-cyanoethyl, 2-chloroethyl, 3-methoxypropyl, 4-phenoxybutyl, 2-carboxyethyl, $-CH_2CH_2SO_3Na$, $-CH_2CH_2NHSO_2CH_3$), a substituted or unsubstituted aryl group (e.g., phenyl, p-methylphenyl, p-methoxyphenyl, o-chlorophenyl, p-octylphenyl, naphthyl), an acyl group (e.g., acetyl, propionyl, benzoyl, octanoyl) and a carbamoyl group (e.g., $-CONHCH_3$, $-CON(CH_3)_2$, $-CONHC_6H_{13}$). In particular, a hydrogen atom, a methyl group, an ethyl group, a phenyl group and an acetyl group are preferred.

L represents a divalent linking group, preferably a group represented by formula (6) or (7).

$$-CO-X_1-L_1-X_2- \quad (6)$$

In the above formula, $X_1$ represents an oxygen atom or $-NR^6$ (wherein $R^6$ is a hydrogen atom, a substituted or unsubstituted alkyl group, a substituted or unsubstituted aryl group, a substituted or unsubstituted acyl group, or a group represented by $-L_1-X_2(R-O)_n-R^2$, preferably a hydrogen atom, a substituted or unsubstituted alkyl group having 1 to 10 carbon atoms (e.g., methyl, ethyl, n-butyl, n-octyl), a group represented by $-L_1-X_2-(R-O)_n-R^2$ or an acyl group (e.g., acetyl, benzoyl)). Of these groups, an oxygen atom or —NH— is particularly preferred as $X_1$.

$L_1$ represents a single bond, a substituted or unsubstituted alkylene group (e.g., dimethylene, trimethylene, tetramethylene, decamethylene, methyldimethylene, phenyldimethylene, $-CH_2(C_6H_4)CH_2-$, $-CH_2CH_2NHCOOCH_2-$), or a substituted or unsubstituted arylene group (e.g., o-phenylene, m-phenylene, p-phenylene, methylphenylene). Of these groups, a single bond or $-(CH_2)_l-$ (l=an integer from 3 to 12) is particularly preferred.

$X_2$ represents a single bond, an oxygen atom, —COO—, —OCO—, $-CONR^6$, $-NR^6CO-$, —OCOO—, $-NR^6COO-$, $-OCONR^6-$, $-NR^6-$(wherein $R^6$ has the same meaning as the above), especially preferably a single bond, an oxygen atom, —COO—, —CONH—, —NHCOO— or —NHCONH—.

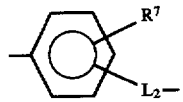

(7)

In the above formula, $R^7$ represents a hydrogen atom, a halogen atom, a substituted or unsubstituted alkyl group, or an acyl group. It is desirable that $R^7$ is a hydrogen atom, a chlorine atom, a lower alkyl group containing not more than 6 carbon atoms, or a lower acyl group. In particular, a hydrogen atom or a methyl group is preferred as $R^7$. $L_2$ represents a single bond, $-L_1-$, $-X_2-$, $-L_1-X_2-$, $-X_1-L_1-X_2-$, or $-CO-X_1-L_1-X_2-$(wherein $X_1$, $X_2$ and $L_1$ have the same meanings as described above, respectively). Of these linkages, $-L_1-$, $-X_2-$ and $-L_1-X_2-$ are preferable, and $-CH_2O-$, —COO—, —CONH— and —O— are particularly preferable.

Further, the repeating unit represented by R—O may be only one kind per monomer, or may take a copolymerized form constituted of two or more kinds.

n represents an average number, by mole, of repeating units, and ranges from 4 to 200. It is preferred that n is in the range of 4 to 50, and particularly preferably from 6 to 40.

Suitable examples of a monomer represented by formula (2) are illustrated below, but the invention should not be construed as being limited to these examples.

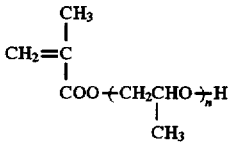

MP-1 n = 6
MP-2 n = 9
MP-3 n = 12
MP-4 n = 20
MP-5 n = 40

MP-1~5

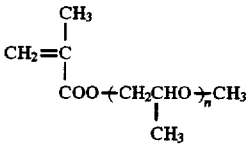

MP-6 n = 4
MP-7 n = 12
MP-8 n = 30

MP-6~8

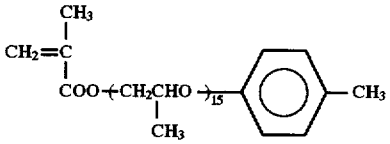

MP-9

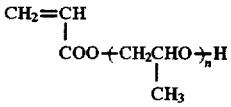

MP-10 n = 6
MP-11 n = 18

MP-10,11

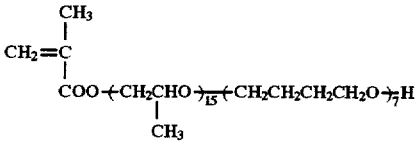

MP-12

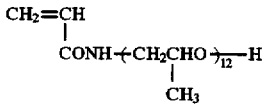

MP-13

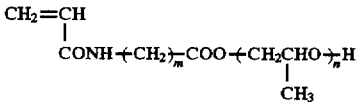

MP-14 m = 5, n = 25
MP-15 m = 3, n = 12

MP-14,15

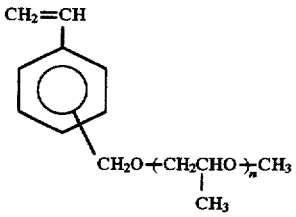

MP-16 n = 8
MP-17 n = 20

MP-16,17

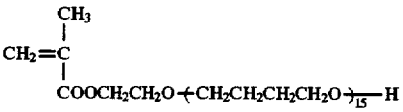

MP-18

ME-1 n = 4
ME-2 n = 9
ME-3 n = 15
ME-4 n = 23
ME-5 n = 50

ME-1~5

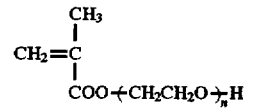

ME-6 n = 6
ME-7 n = 20

ME-6,7

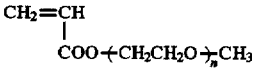

ME-8 n = 9
ME-9 n = 30

ME-8,9

-continued

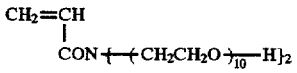

ME-10

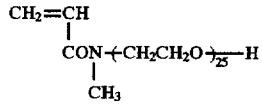

ME-11

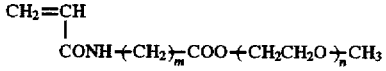

ME-12~14

ME-12 m = 1, n = 20
ME-13 m = 3, n = 15
ME-14 m = 10, n = 30

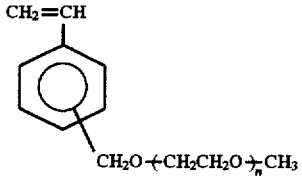

ME-15 n = 8
ME-16 n = 15

ME-15,16

In the case of a vinyl polymer, it is desirable that the polymer be a copolymer of the monomer of formula (2) and monomer(s) other than the monomer of formula (2).

Examples of a monomer capable of copolymerizing with the monomer of formula (2) include acrylic acid esters, methacrylic acid esters, acrylamides, methacrylamides, vinyl esters, vinyl ketones, allyl compounds, olefins, vinyl ethers, N-vinylamides, vinyl heterocyclic compounds, maleic acid esters, itaconic acid esters, fumaric acid ester and crotonic acid esters. Concrete examples of those monomers, include hydrophobic monomers whose homopolymers are insoluble in water, such as methylacrylate, ethylacrylate, n-propylacrylate, n-butylacrylate, sec-butylacrylate, octylacrylate, diethylene glycol monoacrylate, trimethylolethane monoacrylate, 1-bromo-2-methoxyethylacrylate, p-chlorophenylacrylate, methylmethacrylate, ethylmethacrylate, N-tert-butylacrylamide, hexylacrylamide, octylacrylamide, ethyl vinyl ether, propyl vinyl ether, butyl vinyl ether, 2-ethylbutyl vinyl ether, vinyl acetate, vinyl propionate, ethylene, propylene, 1-butene, 1-octene, dioctyl itaconate, dihexyl maleate, styrene, methylstyrene, dimethylstyrene, benzylstyrene, chloromethylstyrene, chlorostyrene, methyl vinylbenzoate, vinyl chlorobenzoate, acrylonitrile, methacrylonitrile, vinyl chloride, etc.; and monomers whose homopolymers are soluble in water, such as acrylamide, N-methylacrylamide, N-ethylacrylamide, N-n-propylacrylamide, N-isopropylacrylamide, N,N-dimethylacrylamide, N-acryloylmorpholine, N-acryloylpiperidine, methacrylamide, N-methylmethacrylamide, N-methacryloylmorpholine, N-vinylpyrrolidone, N-vinylacetamide, COOH-containing monomers (e.g., acrylic acid, methacrylic acid, itaconic acid, maleic anhydride), and monomers containing anionic dissociative groups other than COOH (e.g., 2-acrylamido-2-methylpropanesulfonic acid (or a salt thereof), sodium p-styrenesulfonate, phosphonoxyethylmethacrylate).

Not only the monomers of the foregoing formula (2) but also other ethylenic unsaturated monomers may be used as a mixture of two or more thereof.

It is desirable that the polymer comprising the repeating units of formula (1) of the present invention be soluble in a medium used for formation of tabular grains. Accordingly, it is desired for the polymer to be soluble in an aqueous medium.

In other words, solubility in either water or a mixture of water with an organic solvent miscible with water is adequate for the polymer of the present invention.

The solubility of the polymer in an aqueous medium is at least 1 weight % in distilled water or a distilled water-methanol (9:1 by weight) mixture at room temperature (25° C.).

The proportion of the monomer units of formula (2) in the vinyl polymer of the present invention is from 1 to 90 weight %, preferably from 3 to 85 weight %, and particularly preferably from 5 to 70 weight %.

As the other ethylenic unsaturated monomers to constitute the vinyl polymer, it is desirable to choose monomers whose homopolymers are soluble in water if the solubility of the polymer in an aqueous medium is taken into consideration. Additionally, it is a matter of course that even monomers whose homopolymers are insoluble in water can be used as far as they have no adverse effect upon the solubility of the resulting polymer.

The molecular weight appropriate for the vinyl polymer depends on the polarity of the polymer, the species of monomers used, and so on. However, it is desirable for the polymer to have a weight average molecular weight ranging from $2\times10^3$ to $1\times10^6$, particularly from $3\times10^3$ to $5\times10^5$.

In the next place, polyurethanes which can be used in the present invention are described below.

Polyurethanes preferred in the present invention can be represented by formula (3):

$$\left(O\left(R-O\right)_{n}\right)_{1x}\left(O-R^3-O\right)_{y}\left(CONH-R^4-NHCO\right)_{z} \quad (3)$$

In the above formula, R has the same meaning as in formula (2) illustrated hereinbefore.

$R^3$ represents a divalent linkage group, preferably an alkylene group having 1 to 20 carbon atoms (including substituted alkylene groups), an aralkylene group having 7 to 20 carbon atoms (including substituted aralkylene groups), or a phenylene group having 6 to 20 carbon atoms (including substituted phenylene groups).

The present invention has no particular restriction as to substituent groups which the alkylene, aralkylene or phenylene group as $R^3$ can have. However, halogen atoms (e.g., fluorine, chlorine and bromine atoms), a cyano group, alkoxy groups (e.g., methoxy, ethoxy and benzyloxy groups), aryloxy groups (e.g., phenoxy group), a nitro group, an amino group, a carboxyl group, alkyloxycarbonyl groups (e.g., methoxycarbonyl and propoxycarbonyl groups), acyl groups (e.g., acetyl and benzoyl groups), alkylcarbamoyl groups (e.g., dimethylcarbamoyl group), acylamino groups (e.g., acetylamino group) and a sulfonyl group can be cited as suitable examples of such substituent groups.

$R^4$ represents a divalent linking group, preferably an alkylene group having 1 to 20 carbon atoms (including substituted alkylene groups), an aralkylene group having 7 to 20 carbon atoms (including substituted aralkylene groups) or a phenylene group having 6 to 20 carbon atoms (including substituted phenylene groups).

Groups with which the alkylene, aralkylene or phenylene group as $R^4$ may be substituted, though they have no particular restriction, are preferably a halogen atom (e.g., fluorine, chlorine, bromine), a cyano group, an alkoxy group (e.g., methoxy, ethoxy or benzyloxy), an aryloxy group (e.g., phenoxy), a nitro group, an alkyloxycarbonyl group (e.g., methoxycarbonyl or propoxycarbonyl), an acyl group (e.g., acetyl or benzoyl), an alkylcarbamoyl group (e.g., dimethylcarbamoyl), an acylamino group (e.g., acetylamino), a sulfonyl group and so on.

n represents an average number of the repeating units, and it is in the range of 4 to 200, preferably 4 to 80, and particularly preferably 6 to 40.

When n is less than 4, the corresponding polyurethane cannot satisfactorily contribute to the formation of a monodisperse emulsion; while when n is too great, the number of diols to react with isocyanates is reduced, so it is difficult to efficiently introduce oxyalkylene residues into a polyurethane.

Further, the polyurethanes are described below in detail.

The polyurethanes used in the present invention are synthesized by addition reaction of diol compounds with diisocyanate compounds and polyethylene glycol.

As the diol compounds, a diol represented by formula (8) is firstly used:

$$HO\left(R-O\right)_{n}H \quad (8)$$

wherein R and n have the same meanings as those described hereinbefore, respectively.

Specific examples of such a diol include the compounds illustrated below. (Similarly to the above, each n in the following structural formulae represents the number of repeating units).

$$HO\left(CH_2\underset{\displaystyle CH_3}{\underset{|}{C}}HO\right)_{n}H \quad \text{MP-19}$$

$$HO\left(CH_2CH_2CH_2O\right)_{n}H \quad \text{MP-20}$$

$$HO\left(CH_2CH_2CH_2CH_2O\right)_{n}H \quad \text{MP-21}$$

$$HO\left(CH_2CH_2CH_2CH_2CH_2CH_2O\right)_{n}H \quad \text{MP-22}$$

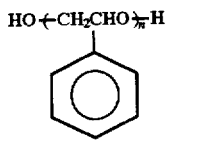

$$HO\left(CH_2CHO\right)_{n}H \quad \text{MP-23}$$

$$HO\left(CH_2\underset{\displaystyle OH}{\underset{|}{C}}HCH_2O\right)_{n}H \quad \text{MP-24}$$

$$HO\left(CH_2\underset{\displaystyle CH_3}{\underset{|}{\overset{\displaystyle CH_3}{\overset{|}{C}}}}O\right)_{n}H \quad \text{MP-25}$$

$$HO\left(\underset{\displaystyle CH_3}{\underset{|}{C}}H-\underset{\displaystyle CH_3}{\underset{|}{C}}H-O\right)_{n}H \quad \text{MP-26}$$

Also, the diol may be a copolymer of two or more of the above-described diols (e.g., a copolymer of MP-1 and MP-3).

In addition to the diol of the foregoing formula (8), another diol represented by formula (9) can be used for the polyurethanes of the present invention:

$$HO-R^3-OH \quad (9)$$

wherein $R^3$ has the same meaning as described hereinbefore.

Specific examples of such an organic diol include ethylene glycol, 1,2-propanediol, 1,3-propanediol, 1,2-butanediol, 1,3-butanediol, 1,4-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl1,2-butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,3-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, 1,4-cyclohexanedimethanol, hydroquinone, diethylene glycol, triethylene glycol, dipropylene glycol, tripropylene glycol.

As the polyurethanes are used for the emulsion-making in an aqueous medium, it is desirable that dissociative groups be introduced into a polymer to heighten the solubility of the polymer in an aqueous medium. Suitable examples of a dissociative group include a carboxyl group, a sulfonic acid group, a sulfuric acid monoester group, —$OPO(OH)_2$, a sulfinic acid group, anionic groups such as salts of these acid groups (e.g., alkali metal salts such as Na salt, K salt, etc., and ammonium salts such as trimethylamine salt), and cationic groups such as quaternary ammonium salts. Of these groups, anionic groups, especially a carboxyl group or a salt thereof, are preferred.

Examples of the diol containing a carboxyl group, include 2,2-bis(hydroxymethyl)propionic acid, 2,2-bis(hydroxymethyl)butanoic acid, 2,5,6-trimethoxy-3,4-dihydroxyhexanoic acid, 2,3-dihydroxy-4,5-dimethoxypentanoic acid, and so on. However, the diol containing a carboxyl group should not be construed as being limited to those examples.

Diisocyanates to constitute the polyurethanes of the present invention are represented by formula (10):

$$O{=}C{=}N{-}R^4{-}N{=}C{=}O \qquad (10)$$

wherein $R^4$ has the same meaning as described hereinbefore.

Suitable examples of such the diisocyanates include methylenediisocyanate, ethylenediisocyanate, isophoronediisocyante, hexamethylenediisocyanate, 1,4-cyclohexyldiisocyante, 2,4-toluenediisocyanate, 2,6-toluenediisocyanate, 1,3-xylylenediisocyanate, 1,4-xylylenediisocyanate, 1,5-naphthalenediisocyanate, m-phenylenediisocyanate, p-phenylenediisocyanate, 3,3'-dimethyl- 4,4'-diphenylmethanediisocyanate, 3,3'-dimethylbiphenylenediisocyanate, 4,4'-biphenylenediisocyanate, dicyclohexylmethanediisocyanate, methylenebis(4-cyclohexylisocyanate) and so on.

Not only the diols represented by the foregoing formulae (8) and (9), but also the diisocyanates represented by formula (10) may be used alone or as a mixture of two or more thereof.

It is desirable similarly to the vinyl polymers that the polyurethanes of the present invention be soluble in a medium used for formation of silver halide emulsion grains, that is, an aqueous medium. The solubility in an aqueous medium is similar to that described hereinbefore.

In formula (3) representing the polyurethanes, x, y and z each represent the corresponding constituent fraction expressed in weight %. Specifically, x is from 1 to 70 weight %, preferably from 3 to 50 weight %, and particularly preferably from 5 to 40 weight %; y, though depends on x, ranges from 1 to 70 weight %, preferably from 2 to 60 weight and particularly preferably from 3 to 50 weight %; and z is from 20 to 70 weight %, preferably from 25 to 65 weight %, and particularly preferably from 30 to 60 weight %.

Further, if the solubility in an aqueous medium is taken into account, it is preferable for the polyurethanes to comprise anionic group (especially carboxyl group) containing diols in a fraction of about 1 to about 30 weight %, particularly preferably 2 to 25 weight %, as a part of the diols represented by formula (9).

The molecular weight appropriate for the polyurethanes, though depends on the polarity of the polymer, the species of their constituent monomers and so on, is in the range of $2\times10^3$ to $5\times10^5$, preferably $3\times10^3$ to $2\times10^5$, in terms of weight average.

Specific examples of the polymers of the present invention comprising repeating units of formula (1) are illustrated below. However, the invention should not be construed as being limited to these examples.

With respect to the vinyl polymers (PP-1 to PP-13 , P-1 to P-29, PE-1 to PE-13), figures in parentheses represent weight % fractions of constituent monomers in each copolymer. As the polyurethanes (PP-14 to PP-18, PE-24 to PE-29), the first set of figures in parentheses represent weight % fractions of constituent monomers in each polymer; while the latter set of figures therein represent mole % fractions. Additionally, the term PPG in the polymers exemplified below stands for polypropylene oxide.

| | |
|---|---|
| PP-1 | MP-3/acrylamide copolymer (10/90) |
| PP-2 | MP-3/acrylamide copolymer (25/75) |
| PP-3 | MP-3/acrylamide copolymer (50/50) |
| PP-4 | MP-3/acrylic acid/acrylamide copolymer (50/30/20) |
| PP-5 | MP-3/acrylic acid copolymer (70-30) |
| PP-6 | MP-2/methacrylamide copolymer (30/70) |
| PP-7 | MP-4/acrylamide copolymer (20/80) |
| PP-8 | MP-7/acrylamide copolymer (30/70) |
| PP-9 | MP-5/acrylamide/methacrylic acid copolymer (25/50/25) |
| PP-10 | MP-12/N,N-dimethylacrylamide/acrylic acid copolymer (30/35/35) |
| PP-11 | MP-7/diacetoneacrylamide copolymer (30/70) |
| PP-12 | MP-13/acrylamide/sodium 2-acrylamido-2-methylpropanesulfonate copolymer (30/60/10) |
| PP-13 | MP-3/MP-18/acrylamide/acrylic acid copolymer (20/20/40/20) |
| PP-14 | Isophorondiisocyanate/sodium 2,2-bis(hydroxymethyl)propionate/PPG (Mw = 400)/PPG (Mw = 1,000) (43.1/21.5/15.7/19.7; 50/35/10/5) |
| PP-15 | Toluenedisiocyante/sodium 2,2-bis(hydroxymethyl)butanoate/PPG (Mw = 1,000) (29.3/20.1/50.6; 50/35/15) |
| PP-16 | 1,5-Naphthylenediisocyanate/potassium 2,2-bis(hydroxymethyl)propionate/PPG (Mw = 400) (47.2/24.8/18.0; 50/40/10) |
| PP-17 | 4,4'-Diphenylmethanediisocyanate/hexamethylenediisocyanate/sodium 2,2-bis(hydroxymethyl)propionate/PPG (Mw = 700) (40.1/6.7/25.0/28.1; 40/10/40/10) |
| PP-18 | 1,5-Naphthylenediisocyanate/hexamethylenediisocyanate/sodium 2,2-bis(hydroxymethyl)butanoate/PPG (Mw = 400)/polybutylene oxide (Mw = 500) (36.2/12.4/29.3/9.8/12.3; 35/15/40/5/5) |
| P-1 | MP-3/ME-4/acrylamide copolymer (5/5/90) |
| P-2 | MP-3/ME-4/acrylamide copolymer (10/10/80) |
| P-3 | MP-3/ME-4/acrylamide copolymer (25/25/50) |
| P-4 | MP-3/ME-4/acrylamide copolymer (35/35/30) |
| P-5 | MP-3/ME-4 copolymer (50/50) |
| P-6 | MP-2/ME-3/acrylamide copolymer (25/15/60) |
| P-7 | MP-5/ME-7/acrylamide/acrylic acid copolymer (20/20/50/10) |
| P-8 | MP-1/MP-4/ME-4/acrylamide copolymer (15/10/25/50) |
| P-9 | MP-5/ME-5/methacrylamide/acrylic acid copolymer (25/25/30/20) |
| P-10 | MP-4/ME-9/acryloylmorpholine/methacrylic acid copolymer (20/10/50/20) |
| P-11 | MP-16/ME-4/acrylamide/sodium 2-acrylamido-2-methylpropanesulfonate copolymer (25/15/45/15) |
| P-12 | MP-9/ME-15/2-hydroxyethylmethacrylate/sodium styrenesulfonate copolymer (10/10/40/40) |
| P-13 | MP-3/ME-2/ME-4/acrylamide copolymer (25/15/15/45) |
| P-14 | MP-3/ME-13/acrylamide copolymer (25/25/50) |
| P-15 | MP-8/ME-9/methylmethacrylate/acrylamide copolymer (20/20/10/50) |
| P-16 | MP-2/ME-2/acrylamide copolymer (7.5/42.5/50) |
| P-17 | MP-2/ME-1/acrylamide copolymer (7.5/42.5/50) |
| P-18 | MP-1/ME-4/acrylamide copolymer (7.5/42.5/50) |
| P-19 | MP-1/ME-2/acrylamide copolymer (7.5/42.5/50) |
| P-20 | MP-2/ME-4/acrylamide copolymer (7.5/42.5/50) |
| P-21 | MP-2/ME-2/acrylamide copolymer (6/34/60) |
| P-22 | MP-2/ME-2/acrylamide copolymer (4.5/23.5/70) |

-continued

| | |
|---|---|
| P-23 | MP-2/ME-4/acrylamide copolymer (25/25/50) |
| P-24 | MP-1/ME-2/acrylamide copolymer (25/25/50) |
| P-25 | MP-1/ME-4/acrylamide copolymer (25/25/50) |
| P-26 | MP-3/ME-2/acrylamide copolymer (25/25/50) |
| P-27 | MP-3/ME-1/acrylamide copolymer (25/25/50) |
| P-28 | MP-3/MP-5/acrylamide copolymer (25/25/50) |
| P-29 | MP-4/ME-5/acrylamide copolymer (25/25/50) |
| PE-1 | ME-4/acrylamide copolymer (10/90) |
| PE-2 | ME-4/acrylamide copolymer (25/75) |
| PE-3 | ME-4/acrylamide copolymer (50/50) |
| PE-4 | ME-4/acrylamide/acrylic acid copolymer (50/25/25) |
| PE-5 | Homopolymer of ME-4 |
| PE-6 | ME-2/acrylamide copolymer (30/70) |
| PE-7 | ME-1/ME-4/methacrylamide copolymer (15/15/70) |
| PE-8 | ME-7/acrylamide/methacrylic acid copolymer (35/60/5) |
| PE-9 | ME-13/N,N-dimethylacrylamide/sodium 2-acrylamido-2-methylpropanesulfonate copolymer (40/45/15) |
| PE-10 | ME-16/sodium styrenesulfonate copolymer (50/50) |
| PE-11 | ME-10/acrylamide/sodium 2-acrylamido-2-methylpropanesulfonate (25/65/10) |
| PE-12 | ME-3/2-hydroxyethylmethacrylate/methacrylic acid copolymer (30/30/40) |
| PE-13 | ME-9/methylacrylate/acrylamide/acrylic acid copolymer (25/15/50/10) |
| PE-14 | Polyethylene glycol (molecular weight: 200–5,000) |
| PE-15 | $CH_3O(CH_2CH_2O)_nH$ (n = 4~100) |
| PE-16 | 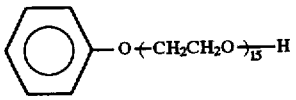 |
| PE-17 | 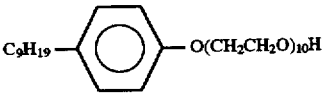 |
| PE-18 | 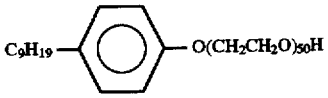 |
| PE-19 | 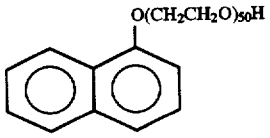 |
| PE-20 | 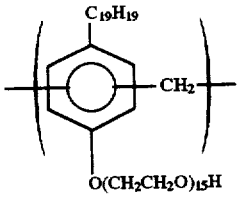 |
| PE-21 | $C_{12}H_{25}O(CH_2CH_2O)_{10}H$ |
| PE-22 | 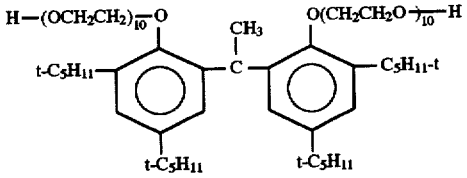 |
| PE-23 | 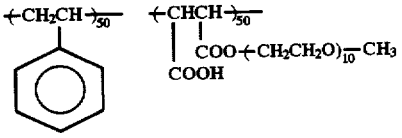 |

-continued

| | |
|---|---|
| PE-24 | Toluenediisocyanate/sodium 2,2-bis(hydroxymethyl)butanoate/polyethylene glycol (Mw = 1,000) (29.3/20.1/50.6; 50/35/15) |
| PE-25 | 4,4'-Diphenylmethanediisocyanate/sodium 2,2-bis(hydroxymethyl)propionate/polyethylene glycol (Mw = 400) (45.3/11.3/43.4; 50/20/30) |
| PE-26 | 4,4'-Diphenylmethanediisocyanate/hexamethylenediisocyanate/ethylene glycol/potassium 2,2-bis(hydroxymethyl)propionate/polyethylene glycol (Mw = 600) (39.1/6.6/2.4/16.8/35.1; 40/10/10/25/15) |
| PE-27 | Isophoronediisocyanate/diethylene glycol/sodium 2,2-bis(hydroxymethyl)propionate/polyethylene glycol (Mw = 400) (48.2/6.9/10.2/34.7; 50/15/15/20) |
| PE-28 | 4,4'-Diphenylmethanediisocyanate/hexamethylenediisocyanate/ethylene glycol/sodium 2,2-bis(hydroxymethyl)butanoate/polyethylene glycol (Mw = 1,000)/polyethylene glycol (Mw = 400) (35.0/5.9/2.2/14.9/35.0/7.0; 40/10/10/25/10/5) |
| PE-29 | 4,4'-Diphenylmethanediisocyanate/sodium 2,2-bis(hydroxymethyl)propionate/polyethylene glycol (Mw = 300)/polyethylene glycol (Mw = 400) (47.9/11.9/17.2/23.0; 50/20/15/20) |

With respect to the synthesis methods of the polymers according to the present invention, those of the vinyl polymers and the polyurethanes are illustrated below.

The vinyl polymers can be synthesized by various polymerization methods, such as solution polymerization, precipitation polymerization, suspension polymerization, block polymerization and emulsion polymerization. As the method of initiating polymerization, the method of using a radical initiator, the method of irradiating with light or radiation and the method of applying heat are exemplified thereof. Those polymerization method and methods of initiating polymerization are described, e.g., in Teiji Tsuruta, *Kobunshi Gosei Hannou* (which means "Polymer Synthesis Reactions"), revised edition, Nikkan Kogyo Shinbunsha, 1971; and Takayuki Otsu & Masayoshi Kinoshita, *Kobunshi Gosei no Jikkenho* (which means "Experimental Methods of Polymer Syntheses"), pages 124–154, Kagaku Dojin, 1972.

Of the foregoing polymerization methods, the solution polymerization method using a radical initiator is preferred.

Specific examples of a solvent used for such the method include water, various organic solvents such as ethyl acetate, methanol, ethanol, 1-propanol, 2-propanol, acetone, dioxane, N,N-dimethylformamide, N,N-dimethylacetamide, toluene, n-hexane, acetonitrile and the like, mixtures of two or more of the above-described organic solvents, and mixtures of water with two or more of the above-described organic solvents. Of these solvents, water or a mixture of water with a water-miscible organic solvent is particularly favorable.

Since it is required to set the temperature for polymerization in relation to the intended molecular weight of a polymer to be synthesized and the species of an initiator used, it is possible to choose the polymerization temperature from the range of from 0° C. to 100° C. In general, however, the polymerization is carried out at temperatures of from 30° C. to 100° C.

Suitable examples of a radical initiator used in the polymerization include azo initiators, such as 2,2'-azobisisobutyronitrile, 2,2'-azobis(2,4-dimethylvaleronitrile), 2,2'-azobis(2-amidinopropane) dihydrochloride, 4,4'-azobis(4-cyanopentanoic acid), etc.; and peroxide initiators, such as benzoyl peroxide, t-butyl hydroperoxide, potassium persulfate (which may be used as a redox initiator in combination with sodium hydrogen sulfite), etc.

As the amount of a polymerization initiator used, though it can be controlled depending on the polymerizing capacities of monomers used and the intended molecular weight of a polymer to be synthesized, the polymerization initiator is preferably used in the proportion of 0.01 to 10 mole %, particularly 0.01 to 2.0 mole %, based on the monomers used.

In preparing the polymers in the form of copolymer, all the monomers to be used may first be placed in a reaction vessel, and then be subjected to a polymerization reaction by throwing an initiator into the reaction vessel. However, it is preferable for the polymers to be synthesized via the step of dropping the monomers into a polymerization medium.

Of the ethylenically unsaturated monomers to be dropped, two or more of them may be mixed together and then dropped, or each of them may be dropped independently. In dropping such monomers, they may be solved in an appropriate auxiliary solvent. The auxiliary solvent used may be water, an organic solvent (e.g., those cited hereinbefore), or a mixture of water with such the organic solvent.

The time required for dropping ethylenically unsaturated monomers depends on their activities in the polymerization reaction, the polymerization temperature chosen, and so on. Preferably, the dropping time is from 5 minutes to 8 hours, particularly from 30 minutes to 4 hours. Further, the dropping speed may be uniform during the dropping, or may be varied adequately within the range of the foregoing dropping time. In the case of independent dropping of ethylenically unsaturated monomers, the total dropping time and the dropping speed of each monomer can be freely changed, if needed. When the ethylenically unsaturated monomers differ greatly in polymerization reactivity, it is desirable that a monomer having higher reactivity be dropped at the lower speed.

The polymerization initiator may be added in advance in a polymerization medium, or may be added simultaneously with ethylenically unsaturated monomer(s). Also, the polymerization initiator may be dissolved in a solvent, and the resulting solution may be dropped independently of ethylenically unsaturated monomers. Additionally, these addition manners may be adopted as a combination of two or more thereof.

The present polyurethane compounds of the present invention have no particular restriction as to the synthesis method thereof, but they are preferably synthesized using the method of reacting diisocyanates with a mixture of the diol containing repeating units of formula (1) illustrated hereinbefore with other diols.

The foregoing synthesis reaction is preferably performed at temperatures of 30° C. to 150° C., particularly 50° C. to 80° C. Also, it is desirable to promote the reaction of isocyanate groups with hydroxyl groups by the addition of a tertiary amine (e.g., tetramethylethylenediamine, 4-dimethylaminopyridine) or an organotin compound (e.g., diibutyltin laurate, dioctyltin laurate) as a catalyst.

Further, an appropriate organic solvent may be used at the time of reaction for the purpose of preventing the reaction product from solidifying or having high viscosity. As such an organic solvent, those which are inert to isocyanate group and have the capacity to dissolve the reaction product can be used to advantage. Specific examples thereof include ketones (such as acetone, methyl ethyl ketone, etc.), ethers (such as tetrahydrofuran, ethylene glycol dimethyl ether, diethylene glycol dimethyl ether, dioxane, etc.), alkyl halogenides (such as chloroform, dichloroethane, etc.), aromatic hydrocarbons (such as benzene, toluene, chlorobenzene, etc.), and amides (such as N,N-dimethylformamide, N,N-dimethylacetamide, etc.). The solvents used can be removed in a usual manner, if desired.

It is advantageous to synthesize polyurethanes according to the methods described, e.g., in Yoshio Iwakura, Ei-ichi Masuhara, Shigeyuki Suzuki and Hisatake Okada, *Kobunshi Kagaku Jikkenho* (which means "Experimental Methods in Polymer Chemistry"), pages 186–187 and 197–204, Asakura Shoten (1965); Gunter Oertel, *Polyurethane Handbook*, page 21 (1985); Shunsuke Murahashi, et al., *Gosei Kobunshi V* (which means "Synthetic Polymers V"), pages 309–359; *Polyurethanes*, compiled by Bridgestone Tire Co., Ltd. and Nippon Trading Co., Ltd. (published by Maki Shoten in 1960); and so on. It is a matter of course that the species of initiator for polyaddition, concentrations of ingredients, polyaddition temperature, reaction time and so on can be widely and easily changed depending on the purpose.

Synthesis examples of the polymers of the present invention are illustrated below.

SYNTHESIS EXAMPLE 1

(Synthesis of Exemplified Compound PP-2):

In a one-liter three necked flask equipped with a stirrer and a reflux condenser, 2.5 g of MP-3, 7.5 g of acrylamide, 0.39 g of sodium hydrogen sulfite, 280 ml of ethanol and 140 g of distilled water were placed, and heated at 70° C. with stirring in a stream of nitrogen.

Thereto, 20 ml of a solution containing 0.20 g of potassium persulfate in water was added, and heated for 1 hour with stirring. Further thereto, a solution containing 0.60 g of potassium persulfate in a mixture of 50 ml of ethanol with 50 ml of distilled water and a solution containing 22.5 g of MP-3 and 67.5 g of acrylamide in a mixture of 100 ml of ethanol with 100 g of distilled water were simultaneously dropped over a 1.5-hour period at a uniform speed.

At the conclusion of the dropping operation, the resulting solution was admixed with 20 ml of a solution containing 0.20 g of potassium persulfate in water, and heated at 70° C. for additional 3 hours with stirring. From the thus obtained polymer solution, ethanol was distilled away under reduced pressure. The residue obtained was reprecipitated from 7 liter of acetone/ethyl acetate (1/1 by volume) mixed solvent. The powder obtained was filtered off, and dried with reduced pressure. Thus, 87.0 g of the intended polymer was obtained. (The weight average molecular weight thereof was 49,700 when determined by gel permeation chromatography.)

SYNTHESIS EXAMPLE 2

(Synthesis of Exemplified Compound PE-2):

In a one-liter three necked flask equipped with a stirrer and a reflux condenser, 2.5 g of ME-4, 7.5 g of acrylamide, 0.39 g of sodium hydrogen sulfite, 280 ml of ethanol and 140 g of distilled water were placed, and heated at 70° C. with stirring in a stream of nitrogen.

Thereto, 20 ml of a water solution containing 0.20 g of potassium persulfate was added, and heated for 1 hour with stirring. Further thereto, a solution containing 0.60 g of potassium persulfate in a mixture of 50 ml of ethanol with 50 ml of distilled water and a solution containing 22.5 g of ME-4 and 67.5 g of acrylamide in a mixture of 100 ml of ethanol with 100 g of distilled water were simultaneously dropped over a 1.5-hour period at a uniform speed.

At the conclusion of the dropping operation, the resulting solution was admixed with 20 ml of a water solution containing 0.20 g of potassium persulfate, and heated at 70° C. for additional 3 hours with stirring. From the thus obtained polymer solution, ethanol was distilled away under reduced pressure. The residue obtained was reprecipitated from 7 liter of acetone/ethyl acetate (1/1 by volume) mixed solvent. The powder obtained was filtered off, and dried under reduced pressure. Thus, 90.5 g of the intended polymer was obtained. (The weight average molecular weight thereof was 47,500 when determined by gel permeation chromatography.)

SYNTHESIS EXAMPLE 3

(Synthesis of Exemplified Compound PE-26):

In a 300 ml three necked flask equipped with a stirrer and a reflux condenser, 19.6 g of 4,4'-diphenylmethanediisocyanate, 3.3 g of hexamethylenediisocyante, 1.2 g of ethylene glycol, 6.5 g of 2,2-bis(hydroxymethyl)propionate, 17.6 g of polyethylene glycol (Mw=600) and 70 ml of dimethylacetamide were placed, and stirred at room temperature to prepare a solution.

The solution was admixed with 0.10 g of di-n-butyltin dilaurate, heated up to 90° C., and stirred for 6 hours at that temperature. Thereafter, the resulting solution was diluted with 30 ml of dimethylformamide, cooled to room temperature, and then admixed with a solution prepared by dissolving 2.7 g of potassium hydroxide in 100 ml of methanol.

The polymer solution obtained was poured into 5-liter of ethyl acetate to deposit a precipitate. The precipitate was filtered off, and then dried to yield 47.3 g of the intended polyurethane PE-26.

SYNTHESIS EXAMPLE 4

(Synthesis of Exemplified Compound P-2):

In a one-liter three necked flask equipped with a stirrer and a reflux condenser, 1.0 g of MP-3, 1.0 g of ME-4, 8.0 g of acrylamide, 0.39 g of sodium hydrogen sulfite, 280 ml of ethanol and 140 g of distilled water were placed, and heated at 70° C. with stirring in a stream of nitrogen.

Thereto, 20 ml of a water solution containing 0.20 g of potassium persulfate was added, and heated for 1 hour with stirring. Further thereto, a solution containing 0.60 g of potassium persulfate in a mixture of 50 ml of ethanol with 50 ml of distilled water and a solution containing 9.0 g of MP-3, 9.0 g of ME-4 and 72 g of acrylamide in a mixture of 100 ml of ethanol with 100 g of distilled water were simultaneously dropped over a 1.5-hour period at a uniform speed.

At the conclusion of the dropping operation, the resulting solution was admixed with 20 ml of a water solution containing 0.20 g of potassium persulfate, and heated at 70° C. for additional 3 hours with stirring. From the thus obtained polymer solution, ethanol was distilled away under reduced pressure. The residue obtained was reprecipitated from 7 liter of acetone/ethyl acetate (1/1 by volume) mixed solvent. The powder obtained was filtered off, and dried under reduced pressure. Thus, 85.5 g of the intended polymer was obtained. (The weight average molecular weight thereof was 53,500 when determined by gel permeation chromatography.)

As another preferred example of the polymer containing repeating units of formula (1), a block polymer of polyalkylene oxides represented by the following formulae (4) and (5) can be illustrated.

This block polymer, which is constituted of polyalkylene oxides, is illustrated below in detail.

Polyalkylene oxide compounds especially useful in the present invention are the polymers which each contain a hydrophobic polyalkylene oxide represented by formula (4) and a hydrophilic polyalkylene oxide represented by formula (5) as a block copolymerizing component:

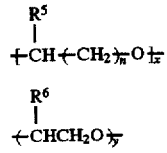

(4)

(5)

wherein $R^5$ represents a hydrogen atom, an alkyl group having 1 to 10 carbon atoms (e.g., methyl, chloromethyl, ethyl, n-butyl), or an aryl group having 6 to 10 carbon atoms (e.g., phenyl, naphthyl); n is an integer of 1 to 10, but when n is 1, $R^5$ is not hydrogen; $R^6$ represents a hydrogen atom, or a lower alkyl group having not more than 4 carbon atoms which is substituted with a hydrophilic group (e.g., hydroxyl, carboxyl), such as a hydroxymethyl group, a carboxymethyl group or the like; and x and y each represent the repetition number of the unit corresponding thereto (i.e., the number average polymerization degree).

With respect to desirable ranges of x and y, though they depend on the polymer structure, x is from 2 to 1,000, preferably from 3 to 500, and that of y is from 1 to 1,000, preferably from 2 to 400.

The ratio between the emulsion layer units of formula (4) and formula (5) in the block polymer can be changed variously depending on the extent of affinity for water or hydrophobicity which each emulsion layer unit has and the kind of an emulsion used. Roughly speaking, however, the ratio is in the range of 4:96 to 96:4 by weight.

Of the hydrophobic polyalkylene oxides represented by formula (4), polypropylene oxide ($R^5$=methyl, n=1) is preferred. Of the hydrophilic polyalkylene oxides represented by formula (5), polyethylene oxide ($R^6$=hydrogen) and polyglycerol ($R^6$=$CH_2OH$) are preferred. In particular, polyethylene oxide is favorable.

As the polymers having the aforementioned block copolymerizing components in each molecule, the compounds which each contain a typical combination of polypropylene oxide with polyethylene oxide as the block copolymerizing component are illustrated in more detail.

Typical examples of such the block polymer as described above are compounds represented by formulae (11) to (18):

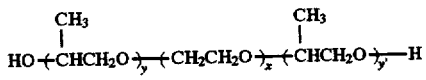

(11)

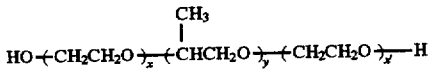

(12)

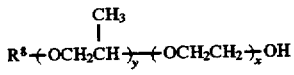

(13)

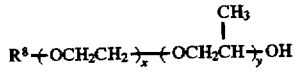

(14)

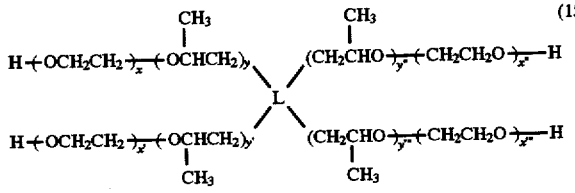

(15)

-continued

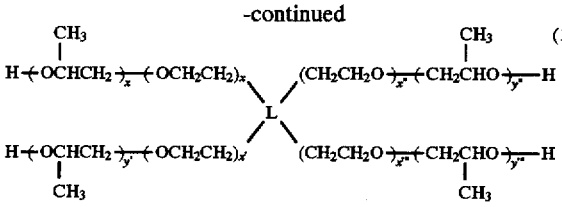

(16)

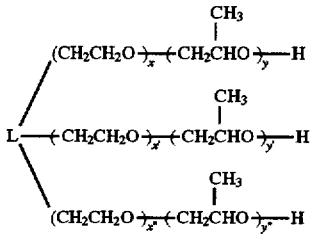

(17)

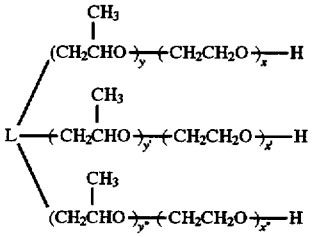

(18)

In the above formulae (11) to (18), x, x', x", x'", y, y', y" and y'" are each the repetition number of the unit corresponding thereto, and they have the same desirable ranges as x in formula (4) and y in formula (5), respectively. $R^8$ represents a monovalent group, with examples including a hydrogen atom and substituted or unsubstituted alkyl and aryl groups. Preferably, $R^8$ is a substituted or unsubstituted lower alkyl group (having not more than 6 carbon atoms). Specific examples of such the alkyl group include methyl, ethyl, n-propyl, isopropyl, t-butyl, chloromethyl, methoxycarbonylmethyl, N-methyl-N-ethylaminoethyl and N,N-diethylaminoethyl.

L represents a trivalent or tetravalent linking group. Specific examples of such linking groups are illustrated below. However, the linking group represented by L should not be construed as being limited to these examples.

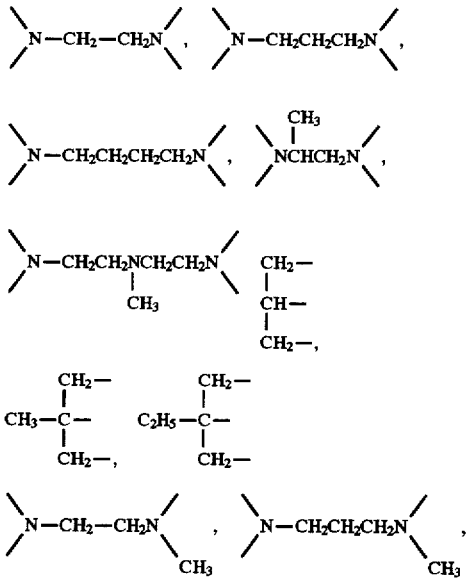

-continued

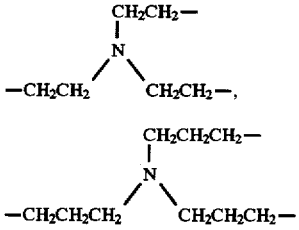

Specific examples of the polymers containing block copolymerizing components in each molecule are listed in the following Table 1 and Table 2. However, the present invention should not be construed as being limited to these examples.

TABLE 1

| Compound No. | Type of Polymer (Formula Number) | $R^8$ | x | y |
|---|---|---|---|---|
| B - 1 | (11) | | 7 | 25 |
| B - 2 | (11) | | 5 | 15 |
| B - 3 | (11) | | 27 | 15 |
| B - 4 | (11) | | 125 | 23 |
| B - 5 | (11) | | 42 | 23 |
| B - 6 | (11) | | 16 | 23 |
| B - 7 | (12) | | 10 | 15 |
| B - 8 | (12) | | 40 | 15 |
| B - 9 | (12) | | 2 | 32 |
| B - 10 | (12) | | 9 | 32 |
| B - 11 | (12) | | 20 | 32 |
| B - 12 | (12) | | 135 | 50 |
| B - 13 | (12) | | 14 | 50 |
| B - 14 | (13) | $CH_3$— | 35 | 30 |
| B - 15 | (13) | $C_3H_7$— | 25 | 50 |
| B - 16 | (13) | $C_2H_5$— | 20 | 70 |
| B - 17 | (14) | $CH_3$— | 40 | 25 |
| B - 18 | (14) | $(CH_3)_2CH$— | 50 | 30 |

TABLE 2

| Compound No. | Type of Polymer (Formula Number) | L | x | y |
|---|---|---|---|---|
| B-19 | (15) | 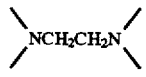 | 2 | 15 |
| B-20 | (15) | | 16 | 17 |
| B-21 | (15) | | 4 | 32 |
| B-22 | (15) | | 140 | 32 |
| B-23 | (15) | | 18 | 20 |
| B-24 | (16) | | 4 | 33 |
| B-25 | (16) | | 108 | 20 |
| B-26 | (15) | 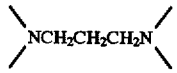 | 15 | 20 |
| B-27 | (17) | 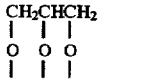 | 10 | 25 |
| B-28 | (17) | | 40 | 20 |
| B-29 | (18) | 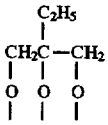 | 15 | 17 |
| B-30 | (18) | | 85 | 33 |

TABLE 2-continued

| Compound No. | Type of Polymer (Formula Number) | L | x | y |
|---|---|---|---|---|
| B-31 | (17) | | 16 | 23 |
| B-32 | (18) | —N— | 25 | 20 |
| B-33 | (18) | | 55 | 30 |

Additionally, in all the formulae representing the above-described compounds, x', x" and x'" take the same value as x, and y', y" and y'" take the same value as y.

General description and specific examples of the block polymers as illustrated above, and preparation examples of silver halide emulsions wherein such polymers are used are described in EP-A-0513722, EP-A-0513723, EP-A-0513724, EP-A-0513725, EP-A-0513742, EP-A-0513743 and EP-A-0518066.

The method of preparing the present silver halide emulsion is illustrated in detail below.

To begin with, a method for preparing silver halide tabular grain emulsion (Step (A)) is described.

The silver halide grain emulsion of the present invention can be prepared via the following processes;

Nucleation→Ripening→Growth

The water-soluble polymers of the present invention, in which the repeating units represented by formula (1) illustrated hereinbefore are contained, may be present in any process of grain formation. However, it is preferred that they are present preferably before at least 50% of the total silver amount used in the growth process are added, more preferably before the growth process, still preferably before the ripening process, most preferably before the nucleation process.

Each of the fundamental processes for forming silver halide (emulsion) tabular grains, namely the nucleation, ripening and growth processes, is described in detail below.

(I) Nucleation

The nucleation of tabular grains is generally carried out using a double jet method wherein an aqueous solution of silver salt and an aqueous solution of alkali halide are added to a reaction vessel holding an aqueous solution of gelatin, or a single jet method wherein an aqueous solution of silver salt is added to a gelatin solution containing alkali halide. Also, a method in which an aqueous solution of alkali halide is added to a gelatin solution containing a silver salt can be adopted, if desired. Further, the nucleation of tabular grains can be performed, if desired, using the method disclosed in JP-A-02-44335 which comprises the step of adding a gelatin solution, a silver salt solution and an aqueous solution of alkali halide to a mixing container, and immediately transferring the resulting mixture into a reaction vessel. Furthermore, as disclosed in U.S. Pat. No. 5,104,786, the nucleation may be accomplished by passing an aqueous solution containing alkali halide and a protective colloid through a pipe and adding thereto an aqueous solution of silver salt.

It is preferred that the nucleation is carried out using protective colloid as a disperse medium and adjusting the pBr to the range of 1 to 4, particularly 1 to 3.5, in the resulting dispersion. As the protective colloid, gelatin and protective-colloid polymers are exemplified. With respect to the type of gelatin, alkali-processed gelatin is usually employed, but phthaloylated gelatin may be used. Preferably used gelatin is low molecular gelatin (molecular weight: 3,000–40,000) or acid-processed gelatin. The protective-colloid polymers which are suitable for the present invention are illustrated below.

(1) Polyvinyl pyrrolidones

Homopolymer of vinyl pyrrolidone, and the acrolein-pyrrolidone copolymer disclosed in French Patent 2,031,396.

(2) Polyvinyl alcohols

Homopolymer of vinyl alcohol, the organic acid monoesters of polyvinyl alcohol as disclosed in U.S. Pat. No. 3,000,741, the maleic acid ester of polyvinyl alcohol as disclosed in U.S. Pat. No. 3,236,653, and the copolymer of polyvinyl alcohol and polyvinyl pyrrolidone as disclosed in U.S. Pat. No. 3,479,189.

(3) Thioether group-containing polymers

The thioether group-containing polymers disclosed in U.S. Pat. Nos. 3,615,624, 3,860,428 and 3,706,564.

(4) Polyvinylimidazoles

Homopolymer of vinyl imidazole, copolymer of polyvinylimidazole and polyvinylamide, and the terpolymers of acrylamide, acrylic acid and vinyl imidazole as disclosed in JP-B-43-7561 (the term "JP-B" as used herein means an "examined Japanese patent publication"), and German Patents 2,012,095 and 2,012,970.

(5) Polyethyleneimines (6) Acetal polymers

The water-soluble polyvinyl acetal disclosed in U.S. Pat. No. 2,358,836, the carboxyl group-containing polyvinyl acetal disclosed in U.S. Pat. No. 3,003,879, and the polymer disclosed in British Patent 771,155.

(7) Amino polymers

The amino polymers disclosed in U.S. Pat. Nos. 3,345,346, 3,706,504 and 4,350,759, and West German Patent 2,138,872; the polymers containing quaternary amines as disclosed in U.S. Pat. No. 3,425,836 and British Patent 1,413,125; the polymers containing amino groups and carboxyl groups as disclosed in U.S. Pat. No. 3,511,818; and the polymers disclosed in U.S. Pat. No. 3,832,185.

(8) Polyacrylamide polymers

Homopolymer of acrylamide, the copolymer of polyacrylamide and imidated polyacrylamide as disclosed in U.S. Pat. No. 2,541,474, the copolymer of acrylamide and methacrylamide as disclosed in West German Patent 1,202,132, the partially aminated acrylamide polymer disclosed in U.S. Pat. No. 3,284,207, and the substituted acrylamide polymers disclosed in JP-B-45-14031, U.S. Pat. No. 3,713,834 and 3,746,548, and British Patent 788,343.

(9) Hydroxyquinoline-containing polymers

The hydroxyquinoline-containing polymers disclosed in U.S. Pat. No. 4,030,929 and 4,152,161.

(10) Others

The azaindenyl group-containing vinyl polymer disclosed in JP-A-59-8604, the polyalkylene oxide derivatives disclosed in U.S. Pat. No. 2,976,150, the polyvinylamineimide polymers disclosed in U.S. Pat. No. 4,022,623, the polymers disclosed in U.S. Pat. Nos. 4,294,920 and 4,089,688, the polyvinylpyridine disclosed in U.S. Pat. No. 2,484,456, the imidazolyl group-containing vinyl polymers disclosed in U.S. Pat. No. 3,520,857, the triazolyl group-containing vinyl polymers disclosed in JP-B-60-658, and the water-soluble polyalkyleneaminotriazoles illustrated in *Zeitschrift Wissenschaftliche Photographie*, vol. 45, page 43 (1950).

It is desirable for the disperse medium to use in a concentration of not more than 10 weight %, preferably not more than 1 weight %.

An appropriate temperature at the time of nucleation is in the range of 5 to 60° C. In forming fine tabular grains having an average grain diameter of not more than 0.5 μm, however, it is preferable to choose the temperature of from 5 to 48° C.

The pH of the disperse medium is desirably 8 or less, preferably 6 or less.

As the composition of an alkali halide solution added, the proportion of $I^-$ to $Br^-$ is below the limitation value for the formation of a solid solution of AgBrI, preferably not more than 10 mole %.

(II) Ripening

In the nucleation (I), fine grains of shapes other than a tabular shape (particularly, octahedral and single twinning grains) are formed. Prior to the growth process described hereinafter, it is required that grains other than tabular grains be made to disappear and highly monodisperse nuclei having shapes to becomes a tabular shape be formed. In order to fulfill this requirement, as well known, Ostwald ripening is performed subsequently to the nucleation.

More specifically, the pBr is controlled immediately after the nucleation, and then the temperature is raised. Under these conditions, ripening is continued until the proportion of hexagonal tabular grains comes to the maximum. Further, the gelatin concentration may be controlled during the ripening. As the gelatin concentration, it is desirable that the proportion of gelatin be from 1 to 10 weight % based on the disperse medium solution. The gelatin used herein is generally an alkali-processed gelatin, but it is also desirable to use acid-processed gelatin and phthaloylated gelatin.

The timing for the addition of gelatin may be at any stage of ripening process. Also, gelatin may be replaced by any of the protective colloid polymers as described hereinabove.

The ripening temperature is in the range of 40° to 80° C., preferably 50° to 80° C., and the pBr is controlled within the range of 1.2 to 3.0.

In carrying out the ripening, a silver halide solvent may also be added for the purpose of rapid disappearance of grains other than tabular grains. The amount of a silver halide solvent added therein is preferably not more than 0.3 mole/l and more preferably not more than 0.2 mole/l. When it is intended to use the emulsion prepared as direct reversal emulsion, the silver halide solvent prefers to be a solvent suitable for use under a neutral or acid condition, such as a thioether compound, rather than a solvent suitable for use under an alkaline condition, such as ammonia.

By the ripening performed in the aforementioned manner, tabular grains alone are obtained in an approximately 100% probability.

At the conclusion of the ripening, the silver halide solvent is removed as follows, unless it is required in the subsequent growth process:

(1) in the case of an alkaline silver halide solvent, such as ammonia, the solvent is nullified by the addition of an acid having a great solubility product with $Ag^+$, such as $HNO_3$, or (2) in the case of a silver halide solvent of thioether type, the solvent is nullified by the addition of an oxidizing agent, e.g., $H_2O_2$, as described in JP-A-60-136736.

(III) Growth

From after the ripening process to before the growth process, gelatin may occasionally be added. In adding gelatin, it is desirable that the gelatin concentration in a disperse medium solution be from 1 to 10 weight %. The gelatin used herein is generally an alkali-processed gelatin, but it is also desirable to use acid-processed gelatin and phthaloylated gelatin. Also, a protective colloid polymer as recited hereinbefore may be used instead of gelatin.

For a crystal-growth period, it is desirable that the pBr be maintained at 1.4–3.5. In addition, it is desirable that the addition speeds of $Ag^+$ and halogen ion(s) at the period of crystal growth be controlled so as to ensure a critical crystal-growth speed to 20–100%, preferably 30–100 of the critical crystal-growth speed. In this period, the addition speeds of $Ag^+$ and halogen ion(s) are increased with the growth of crystals. For this purpose, the aqueous solutions of silver salt and halide(s) may be increased in their addition speeds, as described in JP-B-48-36890 and JP-B-52-16364, or in their concentrations.

Also, the crystal growth may be effected by the addition of previously prepared AgX fine grains to the reaction vessel, as described in JP-A-46-23932 and JP-B-63-30615, or by forming AgX fine grains in a mixer arranged outside of the reaction vessel and immediately thereafter adding them to the reaction vessel, as described in JP-A-01-1834167.

In the period of crystal growth, the concentration of iodide to be deposited on the nuclei is desirably from 0 mole % to the critical concentration for the formation of a solid solution of AgXI.

As the subsequent step (Step (B)), washing of the water-soluble polymer(s) used in Step (A) is described.

The washing of the water-soluble polymer(s) can be effected by use of a conventional flocculation method.

The quantity of the water-soluble polymers removed by such a washing method can be determined by adopting the methods described in *Shinpan Kaimen Kasseizai Bunsekiho* (which means "Newly-published Methods for Analysis of Surfactants"), pages 323–328, compiled by Kaimen Kasseizai Bunseki Kenkyukai, published by Koh Shobo in 1975. More specifically, the cobalt thiocyanate method, the bismuth iodide method and the HPLC analysis can be employed for the determination. Also, the analyses by NMR can be carried out. By undergoing this step, most of the water-soluble polymer(s) added at the time of formation of tabular grains can be removed.

In the final step (Step (C)), the emulsion grains obtained via Steps (A) and (B) are made to further grow. This further growth step can be taken according to the growth step described in (III) of Step (A). Additionally, the water-soluble polymer(s) having the repeating units represented by formula (1) may be present in this growth step also. The quantity of such polymer(s) is desirably from 0.001 to 0.1 time as large as the total amount (by weight) of silver added at the time of growth.

The term "silver halide" used in the present invention means silver bromide, silver iodobromide, and silver chlorobromide and silver chloroiodobromide having a chloride content of not more than 30 mole %.

The silver halide photographic material of the present invention is not particularly restricted as to the other constitutions of emulsion layers, but various additives can be optionally used. With respect to the ingredients which can be added, including chemical sensitizers, spectral sensitizers, antifoggants, metal ion-doping agents, silver halide solvents, stabilizers, dyes, color couplers, DIR couplers, binders, hardeners, coating aids, thickeners, emulsion precipitants, plasticizers, dimensional stability improver, antistatic agents, brightening agents, lubricants, surfactants, ultraviolet absorbents, light scattering or absorbing materials, hardeners, adhesion inhibitors, photographic characteristics improvers (e.g., development accelerators, contrast increasing agents), couplers capable of releasing photographically useful fragments (e.g., a development inhibitor, a development accelerator, a bleaching accelerator, a developer, a silver halide solvent, a toner, a hardener, an antifoggant, a competing coupler, a chemical or spectral sensitizer or desensitizer), image dye stabilizers and self-inhibiting developers; the ways of using the ingredients described above; the supersensitization in spectral sensitization, the effects of a halogen or electron acceptor upon spectral sensitizing dyes, and the actions of an antifoggant, a stabilizer, a development accelerator and a development inhibitor; and emulsion-making apparatus, reactors and agitators applicable to the emulsion, coating and drying methods, exposure systems (a light source, an atmosphere, and a exposure method); and further, photographic supports, micro-porous supports, subbing layers, surface protective layers, matting agents, interlayers, antihalation layers, the layer structure of AgX emulsions, photographic processing chemicals and photographic processing methods; the descriptions in *Research Disclosure,* volume 176, Item 17643 (Dec., 1978), ibid., volume 184, Item 18431 (Aug., 1979), ibid., volume 134, Item 13452 (Jun., 1975), *Product Licensing* Index, volume 92, pages 107–110 (Dec., 1971), JP-A-58-113926, JP-A-58-113927, JP-A-58-113928, JP-A-61-3134, JP-A-62-6251, Nikkakyo Geppo, pages 18-27 (Dec., 1984), JP-A-62-219982, T. H. James, *The Theory of The Photographic Process.,* 4th Ed., Macmillan, New York (1977), and V. L. Zelikman et al., *Making and Coating Photographic Emulsion,* The Focal Press (1964) can be referred to.

The silver halide emulsion of the present invention, if necessary, together with other emulsions can be formed into one or more layers on a support. Further, the emulsion can be provided on not only one side but also both sides of a support. Also, the emulsion having different color sensitivities can be multi-layered.

The silver halide emulsion can be used for black-and-white silver halide photographic materials (e.g., X-ray sensitive materials, lithographic sensitive materials, negative films for taking black-and-white pictures) and color photographic materials (e.g., color negative films, color reversal films, color papers). In addition, the present emulsion can also be employed for diffusion transfer photosensitive materials (e.g., color diffusion transfer elements, silver salt diffusion transfer elements) and heat developable photosensitive materials (black-and-white, and color).

The tabular-grain silver halide emulsion obtained in accordance with the present invention has the characteristics of:

(1) a monodisperse system with respect to the grain shape,
(2) a monodisperse system with respect to projection area diameter, and
(3) uniformity in grain thickness.

In addition, the emulsion enables each grain to undergo optimal chemical sensitization and further, when a large-size grain emulsion, a medium-size grain emulsion and a small-size grain emulsion are coated in layers, such as a high-speed emulsion layer, a medium-speed emulsion layer and a low-speed emulsion layer, respectively, the interlayer effect can be fully achieved. Thus, the present invention can provide a light-sensitive silver halide emulsion having excellent characteristics with regard to sensitivity, gradation, graininess, sharpness, resolution, covering power, image quality, shelf life, latent-image stability and pressure-resisting properties.

EXAMPLE

Now, the present invention will be illustrated in more detail by reference to the following examples, but embodiments of the invention should not to be considered as being limited to these examples.

Comparative Example 1

1) Preparation of Seed Crystals:

To 1.6 liter of a disperse medium solution containing 0.6 g of KBr and 0.8 g of low molecular weight gelatin, which was kept at 40° C. with stirring, 120 ml of a 2.35M silver nitrate solution and 120 ml of a 2.35M KBr solution were added for 1 minute in accordance with a double jet method. In the KBr solution, 4.8 g of low molecular weight gelatin was dissolved, in advance. During the addition, the pBr was maintained at 2.7. After the addition, the disperse medium solution was heated up to 75° C. Immediately after the conclusion of the heating, 350 ml of a 10% gelatin solution was newly added to the disperse medium solution. After the agitation was continued for 15 minutes at 75° C., 164 g of silver nitrate was added at an accelerated flow rate. During the addition, the pBr was maintained at 2.42. The thus obtained emulsion was washed with water, and then dispersed.

2) Growth Process:

One liter of a disperse medium solution containing 30 g of the emulsion obtained in 1) was kept at 75° C. and stirred. Thereto, 145 g of silver nitrate and 145 g of potassium bromide were added at an accelerated flow rate in accordance with a double jet method. Therein, the pBr was maintained at 2.42.

Example 1

1) Preparation of Seed Crystals (Emulsion A):

To 1.6 liter of a disperse medium solution containing 0.6 g of KBr and 0.8 g of low molecular weight gelatin, which was kept at 40° C. with stirring, 120 ml of a 2.35M silver nitrate solution and 120 ml of a 2.35M KBr solution were added for 1 minute in accordance with a double jet method. In the KBr solution, 4.8 g of low molecular weight gelatin was dissolved, in advance. During the addition, the pBr was maintained at 2.7. After the addition, the disperse medium solution was heated up to 75° C. Immediately after the conclusion of the heating, 2 g of a synthetic polymer (P-3) was added, and the pH was adjusted to 7. After 20 minutes' stirring at 75° C., 350 ml of a 10% gelatin solution was added to the resulting disperse medium solution and further, the pH was adjusted to 5. After a 1-minute lapse, 164 g of silver nitrate was added at an accelerated flow rate. During the addition, the pBr was maintained at 2.42.

2) Washing-out of Synthetic Polymer:

The emulsion obtained in 1) was washed with water for three times according to the conventional flocculation method. The supernatant solution in each washing operation was collected and analyzed for the synthetic polymer according to the cobalt thiocyanate method described hereinbefore. As a result, it was found that 91.5% of the polymer was removed by the washing. The thus washed emulsion was dispersed.

3) Growth Process:

One liter of a disperse medium solution containing 30 g of the emulsion obtained in 2) was kept at 75° C. and stirred. Thereto, 145 g of silver nitrate and 145 g of potassium bromide were added at an accelerated flow rate in accordance with a double jet method. Therein, the pBr was maintained at 2.42.

Example 2

1) Preparation of Seed Crystals (Emulsion B):

To 1.6 liter of a disperse medium solution containing 0.6 g of KBr and 0.8 g of low molecular weight gelatin, which was kept at 40° C. with stirring, 120 ml of a 2.35M silver nitrate solution and 120 ml of a 2.35M KBr solution were added for 1 minute in accordance with a double jet method. In the KBr solution, 4.8 g of low molecular weight gelatin was dissolved, in advance. During the addition, the pBr was maintained at 2.7. After the addition, the disperse medium solution was heated up to 75° C. Immediately after the conclusion of the heating, synthetic polymers (2 g of PP-2 and 2 g of PE-3) were added, and the pH was adjusted to 7. After 20 minutes' stirring at 75° C., 350 ml of a 10% gelatin solution was added to the resulting disperse medium solution and further, the pH was adjusted to 5. After a 1-minute lapse, 164 g of silver nitrate was added at an accelerated flow rate. During the addition, the pBr was maintained at 2.42.

2) Washing-out of Synthetic Polymers:

The emulsion obtained in 1) was washed with water for three times according to the conventional flocculation method. The supernatant solution in each washing operation was collected and analyzed for the synthetic polymers according to the cobalt thiocyanate method described hereinbefore. As a result, it was found that 92.2% of the total polymers (PP-2 plus PE-3) was removed by the washing. The thus washed emulsion was dispersed.

3) Growth Process:

One liter of a disperse medium solution containing 30 g of the emulsion obtained in 2) was kept at 75° C. and stirred. Thereto, 145 g of silver nitrate and potassium bromide were added at an accelerated flow rate in accordance with a double jet method. Therein, the pBr was maintained at 2.42.

The sizes of grains obtained in Comparative Example 1, Example 1 and Example 2 respectively are set forth in Table 3.

TABLE 3

| | | Comparative Example 1 | Example 1 | Example 2 |
|---|---|---|---|---|
| Seed-Crystal Emulsion | Polymer used | — | P-3 | PP-2, PE-3 |
| | Projection Area Diameter | 0.34 μm | 0.29 μm | 0.28 μm |
| | (Variation Coefficient) | (32.1%) | (22.4%) | (22.8%) |
| | Thickness | 0.08 μm | 0.09 μm | 0.09 μm |
| Grown-Grain Emulsion | Projection Area Diameter | 1.15 μm | 1.12 μm | 1.11 μm |
| | (Variation Coefficient) | (20.1%) | (14.2%) | (15.1%) |
| | Thickness | 0.11 μm | 0.12 μm | 0.12 μm |

As is apparent from Table 3, the grains with a monodisperse distribution of projection area diameters were obtained when the distribution of projection area diameters of seed crystals was rendered monodisperse by use of the synthetic polymer(s) and the resulting monodisperse seed crystals were made to grow.

Example 3

A grown-grain emulsion was prepared in the same manner as in Example 1, except that the synthetic polymer P-3 was present in the growth process also and the pH was kept at 6.3. Additionally, Emulsion A prepared in Example 1 was used as seed crystals in this example also. The grain size of the thus obtained emulsion is shown below (in Table 4):

TABLE 4

| | | Example 1 | Example 3 |
|---|---|---|---|
| Grown-Grain Emulsion | Projection Area Diameter | 1.12 μm | 1.11 μm |
| | (Variation Coefficient) | (14.2%) | (11.5%) |
| | Thickness | 0.12 μm | 0.13 μm |

Due to the presence of the present polymer in the growth process also, a further monodisperse emulsion was obtained.

Comparative Example 2

Formation of AgBrI tabular grains:

To 1.6 liter of a disperse medium solution containing 0.6 g of KBr and 0.8 g of low molecular weight gelatin, which was kept at 40° C. with stirring, 120 ml of a 2.35M silver nitrate solution and 120 ml of a 2.35M KBr solution were added for 1 minute in accordance with a double jet method. In the KBr solution, 4.8 g of low molecular weight gelatin was dissolved, in advance. During the addition, the pBr was maintained at 2.7. After the addition, the disperse medium solution was heated up to 75° C. Immediately after the conclusion of the heating, 2 g of a synthetic polymer (P-3) was added, and the pH was adjusted to 7. After 20 minutes' stirring at 75° C., 350 ml of a 10% gelatin solution was added to the resulting disperse medium solution, and the pH was adjusted to 5. After a 1-minute lapse, 164 g of silver nitrate was added at an accelerated flow rate. During the addition, the pBr was maintained at 2.42. After the conclusion of the addition, a 80 ml portion of the emulsion solution thus obtained was collected, and added to a gelatin solution kept at 75° C. in a separate reaction vessel. While the resulting admixture is stirred, 145 g of silver nitrate was added thereto at an accelerated flow rate in accordance with a double jet method. In this step, the halide solution added simultaneously was a potassium bromide solution containing 4 mole % of potassium iodide, and the pBr was maintained at 2.42 during the simultaneous addition.

Example 4

1) Preparation of Seed Crystals (Emulsion C):

To 1.6 liter of a disperse medium solution containing 0.6 g of KBr and 0.8 g of low molecular weight gelatin, which was kept at 40° C. with stirring, 120 ml of a 2.35M silver nitrate solution and 120 ml of a 2.35M KBr solution were added for 1 minute in accordance with a double jet method. In the KBr solution, 4.8 g of low molecular weight gelatin was dissolved, in advance. During the addition, the pBr was maintained at 2.7. After the addition, the disperse medium solution was heated up to 75° C. Immediately after the conclusion of the heating, 2 g of a synthetic polymer (P-3) was added, and the pH was adjusted to 7. After 30 minutes' stirring at 75° C., a gelatin solution was newly added to the resulting disperse medium solution, and the pH was adjusted to 5. After a 1-minute lapse, 164 g of silver nitrate was added at an accelerated flow rate. During the addition, the pBr was maintained at 2.42.

2) Washing-out of Synthetic Polymer:

The emulsion obtained in 1) was washed with water for three times according to the conventional flocculation method. The supernatant solution in each washing operation was collected and analyzed for the synthetic polymer according to the cobalt thiocyanate method described hereinbefore. As a result, it was found that 91.3% of the polymer was removed by the washing. The thus washed emulsion was dispersed.

3) Growth Process:

One liter of a disperse medium solution containing 30 g of the emulsion obtained in 2) was kept at 75° C. and stirred. Thereto, 145 g of silver nitrate was added at an accelerated flow rate in accordance with a double jet method. In this step, the halide solution added simultaneously was a potassium bromide solution containing 4 mole % of potassium iodide. During the simultaneous addition, the pBr was maintained at 2.42.

The sizes of grains obtained in Comparative Example 2 and Example 4 respectively are set forth in Table 5.

TABLE 5

| | | Comparative Example 2 | Example 4 |
|---|---|---|---|
| Grown-Grain Emulsion | Projection Area Diameter (Variation Coefficient) | 0.81 μm (15.8%) | 1.13 μm (14.1%) |
| | Thickness | 0.22 μm | 0.12 μm |

As is apparent from Table 5, when the growth of AgBrI was carried out without removing the synthetic polymer used, the thickness of tabular grains was increased to decrease the aspect ratio; while monodisperse tabular grains having small thickness and high aspect ratio was obtained when most of the synthetic polymer was removed by washing.

Example 5

A grown-grain emulsion was prepared in the same manner as in Example 4, except that the present synthetic polymer P-18 was present in the growth process also and the pH was kept at 5.0. Additionally, Emulsion C prepared in Example 4 was used as seed crystals in this example also. The grain size of the thus obtained emulsion is shown below (in Table 6):

TABLE 6

| | | Example 4 | Example 5 |
|---|---|---|---|
| Grown-Grain Emulsion | Projection Area Diameter (Variation Coefficient) | 1.13 μm (14.1%) | 1.11 μm (11.8%) |
| | Thickness | 0.12 μm | 0.13 μm |

The above data demonstrate that a further monodisperse AgBrI tabular grains having a high aspect ratio were obtained when a polymer suitable for AgBrI was newly present in the growth step of AgBrI grains, as in this example, after the polymer used for rendering the seed crystals of AgBr monodisperse was removed by washing.

Comparative Example 3

Emulsion grains were prepared according to the method adopted in Example 5 of U.S. Pat. No. 5,210,013.

More specifically, to 1 liter of a disperse medium solution containing 1.3 g of KBr, 0.83 g of acid-processed gelatin, 15.2 ml of 1N nitric acid and 0.11 g of PLURONIC TM31R1 (produced by BASF Co., corresponding to Compound B-1 of the present invention), which was kept at 45° C. with stirring, were added 8.53 ml of a 1N silver nitrate solution and 8.53 ml of a 1N KBr solution at the addition speed of 8.53 ml/min in accordance with a double jet method. After a 1-minute lapse, the resulting emulsion was admixed with 16.9 ml of a 0.84N KBr solution, and heated up to 60° C. After the conclusion of heating, 16.8 ml of a water solution containing 3.36 g of ammonium sulfate and 27 ml of 2.5N NaOH were simultaneously added to the heated emulsion. After 9 minutes' agitation, the emulsion was admixed with 167 ml of a 10% gelatin solution, 43 ml of 1N nitric acid and 0.11 g of PLURONIC TM31R1 (same polymer used above), and agitated for 2 minutes. Thereto, 7.5 ml of 0.8N silver nitrate and 7.5 ml of 0.8N KBr were added at an addition speed of 2.5 ml/min. Further thereto, 79.6 ml of a 1.6 N silver nitrate solution and 79.6 ml of a 1.6N KBr solution were added over a 22-minute period.

After the conclusion of the addition, 1,050 ml portion of the thus obtained emulsion solution was collected, and added to a gelatin solution kept at 75° C. in a separate reaction vessel. As the resulting solution was agitated, 132.6 g of silver nitrate was added thereto at an accelerated flow rate in accordance with a double jet method. In this step, the halide solution added simultaneously was a potassium bromide solution containing 4 mole % of potassium iodide. During the simultaneous addition, the pBr was maintained at 2.42.

Example 6

1) Preparation of Seed Crystals (Emulsion D):

To 1 liter of a disperse medium solution containing 1.3 g of KBr, 0.93 g of acid-processed gelatin, 15.2 ml of 1N nitric acid and 0.11 g of PLURONIC TM31R1 (produced by BASF Co., corresponding to Compound B-1 of the present invention), which was kept at 45° C. with stirring, were added 8.53 ml of a 1N silver nitrate solution and 8.53 ml of a 1N KBr solution at the addition speed of 8.53 ml/min in accordance with a double jet method. After a 1-minute lapse, the resulting emulsion was admixed with 16.9 ml of a 0.84 N KBr solution, and heated up to 60° C. After the conclusion of heating, 16.8 ml of a water solution containing 3.36 g of ammonium sulfate and 27 ml of 2.5N NaOH were simultaneously added to the heated emulsion. After 9 minutes' agitation, the emulsion was admixed with 167 ml of a 10% gelatin solution, 43 ml of 1N nitric acid and 0.11 g of PLURONIC TM31R1 (same polymer used above), and agitated for 2 minutes. Thereto, 7.5 ml of 0.8N silver nitrate and 7.5 ml of 0.8N KBr were added at an addition speed of 2.5 ml/min. Further thereto, 79.6 ml of a 1.6N silver nitrate solution and 79.6 ml of a 1.6N KBr solution were added over a 22-minute period.

2) Washing-out of Polymer (PLURONIC):

The emulsion obtained in 1) was washed with water for three times according to the conventional flocculation method. The supernatant solution in each washing operation was collected and analyzed for the synthetic polymer according to the cobalt thiocyanate method described hereinbefore. As a result, it was found that 89.5% of the polymer was removed by the washing. The thus washed emulsion was dispersed.

3) Growth Process:

One liter of a disperse medium solution containing 360 g of the emulsion obtained in 2) was kept at 75° C. and agitated. Thereto, 132.6 g of silver nitrate was added at an accelerated flow rate in accordance with a double jet method. In this step, the halide solution added simultaneously was a potassium bromide solution containing 4 mole % of potassium iodide. During the simultaneous addition, the pBr was maintained at 2.42.

The sizes of grains obtained in Comparative Example 3 and Example 6 respectively are shown in Table 7.

TABLE 7

| | | Comparative Example 3 | Example 6 |
|---|---|---|---|
| Grown-Grain Emulsion | Projection Area Diameter | 0.75 μm | 1.05 μm |
| | (Variation Coefficient) | (12.5%) | (12.1%) |
| | Thickness | 0.26 μm | 0.13 μm |

As is apparent from Table 7, when the growth of AgBrI was carried out without removing the synthetic polymer used, the thickness of tabular grains was increased to decrease the aspect ratio; while monodisperse tabular grains having small thickness and high aspect ratio was obtained when the synthetic polymer was removed by washing.

Example 7

The emulsion obtained in Example 2 was washed with water according to the conventional flocculation method, and then redispersed. The thus obtained emulsion was used for the fifth layer of the sensitive material in Sample 6 of Example 3 (Sample No. 101) in JP-A-06-258788, and subjected to the same processing as in the example of the above reference. As a result, satisfactory properties were obtained.

Example 8

The emulsion obtained in Example 5 was used as the emulsion of Sensitive Material X in Example 1 of JP-A-06-273860, combined with Screen B, and processed in the same manner as in the example of the reference cited above. As a result, satisfactory properties were obtained.

Example 9

The emulsion obtained in Example 5 was used for the sixth layer of the sensitive material (Sample No. 101) of Example 1 in JP-A-02-854, and subjected to the same processing as in the example of the above reference. As a result, satisfactory properties were obtained.

While the invention has been described in detail and with reference to specific embodiments thereof, it will be apparent to one skilled in the art that various changes and modifications can be made thertein without departing from the spirit and scope thereof.

What is claimed is:

1. A method of preparing a silver halide emulsion comprising a disperse medium and silver halide grains, said method comprising the steps of:

(1) forming silver halide tabular grains for the silver halide emulsion in the presence of at least one polymer having repeating units represented by formula (1), (2) subsequently to the step (1), removing the polymer by washing with water, and (3) using as seed crystals the silver halide tabular grains obtained via steps (1) and (2) and further growing these grains;

$$-(R-O)_n- \quad (1)$$

wherein each R represents an alkylene group having 2 to 10 carbon atoms, and n is an average number of repeating units which ranges from 4 to 200.

2. The method of preparing a silver halide emulsion as in claim 1, wherein the polymer comprising the repeating units of formula (1) is at least one polymer selected from the group consisting of vinyl polymers comprising as constituent monomer at least one monomer represented by formula (2) and polyurethanes represented by formula (3):

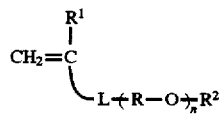

(2)

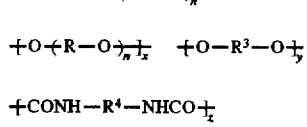

(3)

wherein R and n have the same meanings as in formula (1), respectively; $R^1$ represents a hydrogen atom or a lower alkyl group; $R^2$ represents a monovalent substituent group; L represents a divalent linking group; $R^3$ and $R^4$ each represent an alkylene group having 1 to 20 carbon atoms, a phenylene group having 6 to 20 carbon atoms or an aralkylene group having 7 to 20 carbon atoms; and x, y and z are each the corresponding constituent fraction expressed in weight %, wherein x is from 1 to 70, y is from 1 to 70 and z is from 20 to 70, provided that x+y+z is 100.

3. The method of preparing a silver halide emulsion as in claim 1, wherein the polymer comprising the repeating units of formula (1) is a polymer containing polyalkylene oxides represented by formula (4) and formula (5), respectively, as block polymerizing components:

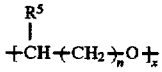

(4)

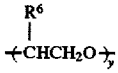

(5)

wherein $R^5$ represents a hydrogen atom, an alkyl group having 1 to 10 carbon atoms, or an aryl group having 6 to 10 carbon atoms; n is an integer of 1 to 10, provided that when n is 1, $R^5$ is not hydrogen; $R^6$ represents a hydrogen atom, or a lower alkyl group having 4 carbon atoms or less which is substituted with a hydrophilic group; and x and y each represent the repetition number of the unit corresponding thereto (the number average polymerization degree).

4. The method of preparing a silver halide emulsion as in claim 1, wherein at least one polymer comprising the repeating units represented by formula (1) is present during the grain growth as the step (3).

5. The method of preparing a silver halide emulsion as in claim 1, wherein the pBr at the time of nucleation in the step of forming tabular grains is in the range of 1.0 to 3.5.

6. The method of preparing a silver halide emulsion as in claim 1, wherein the silver halide grains are tabular grains having an aspect ratio of at least 2 and a variation coefficient of not more than 20% with respect to the diameters of circle equivalents.

7. The method of preparing a silver halide emulsion as in claim 1, wherein the proportion of bromide is at least 80 mole % to the total amount of silver.

8. A silver halide photographic material comprising a support having thereon at least one light-sensitive silver halide emulsion layer, wherein the silver halide emulsion layer comprises a silver halide emulsion prepared by a method of preparing a silver halide emulsion comprising a disperse medium and silver halide grains, said method comprising the steps of:

(1) forming silver halide tabular grains for the silver halide emulsion in the presence of at least one polymer having repeating units represented by formula (1), (2) subsequently to the step (1), removing the polymer by washing with water, and (3) using as seed crystals the silver halide tabular grains obtained via steps (1) and (2) and further growing these grains;

$$-(R-O)_n- \quad (1)$$

wherein each R represents an alkylene group having 2 to 10 carbon atoms, and n is an average number of repeating units which ranges from 4 to 200.

* * * * *